US007909406B2

(12) United States Patent
Samuelsen

(10) Patent No.: US 7,909,406 B2
(45) Date of Patent: Mar. 22, 2011

(54) RESTING APPARATUS

(76) Inventor: Leif-Erik A. Samuelsen, Edgerton, WI (US)

( * ) Notice: Subject to any disclaimer, the term of this patent is extended or adjusted under 35 U.S.C. 154(b) by 232 days.

(21) Appl. No.: 12/269,787

(22) Filed: Nov. 12, 2008

(65) Prior Publication Data

US 2010/0117435 A1 May 13, 2010

(51) Int. Cl.
*A47C 7/38* (2006.01)

(52) U.S. Cl. ..... 297/397; 297/392; 297/393

(58) Field of Classification Search ..... 297/391, 297/392, 393, 397, 487; 5/636, 652
See application file for complete search history.

(56) References Cited

U.S. PATENT DOCUMENTS

| | | | | | |
|---|---|---|---|---|---|
| 2,638,293 | A | * | 5/1953 | Lindstrom | 244/122 AE |
| 2,986,202 | A | * | 5/1961 | Yates | 297/188.2 |
| 3,285,658 | A | * | 11/1966 | Cleveland | 297/395 |
| 3,608,964 | A | * | 9/1971 | Earl | 297/397 |
| 4,001,902 | A | | 1/1977 | Hall et al. | |
| 4,097,086 | A | * | 6/1978 | Hudson | 297/217.1 |
| 4,182,322 | A | * | 1/1980 | Miller | 5/637 |
| 4,235,472 | A | | 11/1980 | Sparks et al. | |
| 4,339,151 | A | * | 7/1982 | Riggs | 297/464 |
| 4,565,408 | A | * | 1/1986 | Palley | 297/393 |
| 4,707,031 | A | * | 11/1987 | Meistrell | 297/393 |
| 5,505,523 | A | * | 4/1996 | Wang | 297/393 |
| 5,560,056 | A | | 10/1996 | Tai | |
| 5,611,601 | A | * | 3/1997 | Cowgur | 297/393 |
| 5,645,319 | A | | 7/1997 | Parks, Jr. | |
| 6,042,185 | A | * | 3/2000 | Cowgur | 297/393 |
| 6,135,560 | A | | 10/2000 | Fagg | |
| 6,266,825 | B1 | * | 7/2001 | Floyd | 2/338 |
| 6,289,538 | B1 | * | 9/2001 | Fidge | 5/640 |
| 6,301,716 | B1 | * | 10/2001 | Ross | 2/171 |
| 6,353,946 | B1 | | 3/2002 | Steiner | |
| 6,394,554 | B1 | | 5/2002 | Hingle | |
| 6,554,363 | B1 | | 4/2003 | Silva | |
| 6,607,245 | B1 | * | 8/2003 | Scher | 297/393 |
| 6,647,573 | B2 | | 11/2003 | Corbin | |
| 6,721,978 | B1 | | 4/2004 | Tankersley | |
| 6,793,287 | B2 | * | 9/2004 | Dunk | 297/397 |
| 6,805,403 | B2 | * | 10/2004 | Buch | 297/146 |
| 6,973,691 | B1 | | 12/2005 | Cordova et al. | |
| 7,393,057 | B2 | | 7/2008 | Fraser | |
| 2002/0050009 | A1 | | 5/2002 | Ley | |
| 2004/0026979 | A1 | * | 2/2004 | Haddon | 297/393 |
| 2008/0303318 | A1 | * | 12/2008 | Hamilton | 297/129 X |

* cited by examiner

*Primary Examiner* — Rodney B White
*Assistant Examiner* — Joseph Edell
(74) *Attorney, Agent, or Firm* — Absolute Technology Law Group, LLC

(57) ABSTRACT

The invention disclosed herein is securely supported resting apparatus that includes a resting platform sufficient to support the leaning weight of the user and a configuration of straps to provide support in a limited or enclosed space.

9 Claims, 4 Drawing Sheets

RESTING APPARATUS

FIELD OF INVENTION

This invention relates generally to the field of headrests, and in particular to a resting apparatus which is secured by a user's seat and provides frontal resting support during use.

BACKGROUND

There have also been attempts in the art to create travel pillows that provide frontal support so that a traveler may lean forward to rest. U.S. Pat. No. 6,647,573 (Corbin '573) teaches a travel pillow designed to provide support from the front with an inflatable pillow that sits on a typical airline tray to provide a resting area for the front of a user's head.

Thus, it is well recognized among regular passengers on commercial carriers that it is often difficult to relax in the seats provided. In particular, economy class seating on aircraft and buses typically provides closely-spaced forward facing seats in rows separated by a very small space. These seats severely restrict the passenger's movement out of the sitting position, causing fatigue and discomfort during the journey. Other closely-spaced seating arrangements in confined spaces, such as classrooms, emergency shelters or other spaces, encounter similar problems There are many devices known in the prior art directed towards providing a surface for persons to comfortably rest while in a sitting position. However, these devices do not adequately solve the problem of providing comfort and support for persons desiring to rest. Most traditional pillows do not allow the user to optimally use all available space in a semi-confined group-seating situation. The spaces immediately in front of or side to side of a sitting user has not been adequately used for providing a comfortable resting area.

Those devices aimed towards providing a headrest are limited and not adjustable for the anthropometric proportions of different users to provide maximum comfort and support. Traditional pillows are helpful, but they can be bulky and not easily storable. They also offer limited head and neck support for typically sitting user because the angles at which a user sits even in most reclinable chairs do not provide adequate support for a user's neck and back in a resting position.

It is thus desirable to have a resting apparatus that efficiently, economically and safely addresses both space constraints in travel and group seating situations, and which can be easily stored and transported.

Glossary

As used herein, the term "resting apparatus" refers to a cushion that is securely supported by one or more upward angular forces that are sufficient to bear the leaning weight.

As used herein, the term "leaning weight" refers to weight of a sitting or partially sitting person placed upon an object so that the person may rest the head or other body parts comfortably during sleep.

As used herein, the term "resting platform" refers to a platform with an inner support structure to support the leaning weight of a person, which may include padding, foam, fabric, heating elements, scented components, textured components, vibrating components, audio components, sound buffering components or other features, materials and components to assist in rest.

As used herein, the term "strap system" refers to a configuration of straps to create a sufficient upward and/or diagonal force to support a leaning weight.

As used herein, the term "securing component" refers to structure or material used to secure a strap, including but not limited to Velcro, elastic rubber, buckles, hooks, snaps, suction cups, ties, ropes or other closure devices known in the art.

As used herein, the term "inner support structure" refers to a portion of a resting platform that provides rigid or semi-rigid support and may be constructed of wood, plastic, hardboard, fiberglass or any other material known in the art.

As used herein, the term "panels" refer to one embodiment of an inner support structure.

As used herein, the term "resting platform attachment points" refers to one or more locations on an inner support structure that securely or detachably connects to a strap system.

As used herein, the term "support loop straps" refers to one embodiment of resting platform attachment points that provide secure support to a strap system.

As used herein, the term "single release side adjust buckle" means a buckle which is configured to allow a strap length to be adjusted by pulling the strap through a structural configuration on one or both sides of the buckle.

As used herein, the term "cushion layers" refers to a portion of a resting platform containing one or more layers of foam or padding including but not limited to wool, hair, feathers, fibers, non-woven materials, paper, high-density foam, heating elements, scented components, textured components, vibrating components, audio components, sound buffering components or other features, materials and components to assist in rest.

As used herein, the term "removable cover" refers to an optional cover, which may be washable or may include additional components including but not limited to heating elements, scented components, textured components, vibrating components, audio components, a storage pocket components, sound buffering components or other features, materials and components to assist in rest.

As used herein, the term "buckle strap" refers to a strap which is part of a resting platform and which is slidably connected on one end to a support loop strap and on another end connected to a female buckle end.

As used herein, the term "buckle" refers to any snap closure, adjustable strap configuration, clasp or mechanical device to connect a resting platform to a suspension strap component and contains a male buckle member that is removably and adjustably secured to a female buckle member.

As used herein, the term "female buckle end" refers the portion of a buckle that accepts a complimenting buckle end.

As used herein, the term "supporting object" means a chair back or any structure that can accommodate a chair strap to support a suspension strap.

As used herein, the term "male buckle end" refers to the portion of a buckle that enters a complimenting buckle end.

As used herein, the term "suspension strap" refers to a strap which provides one upward and diagonal forces to resting platform and in various embodiments may be combined with a chair strap.

As used herein, the term "enveloping components" refers to fabric or other material which is secured, fastened, closed or sewn on two ends to provide a channel that slidably accepts a suspension strap. At least one outer surface of enveloping components contains a pressure resistant attachment substance to provide an attachment portion for a chair strap.

As used herein, the term "chair strap" refers to a strap that is removably attachable to a chair by means of pressure resistant attachment substance. When attached, the outer surface of a chair strap contains a pressure resistance attachment substance to provide an attachment portion for the enveloping components of a strap system.

As used herein, the term "pressure resistant attachment substance" refers to any sliding engaging fasteners or hook and loop fasteners and may include stitching, adhesives, interlocking components, or other connecting components known in the art.

As used herein, "anthropometric" or "anthropometrically" means contoured to adapt or accommodate the structure and physiology of the human body.

SUMMARY OF THE INVENTION

The invention disclosed herein is securely supported resting apparatus that includes a resting platform sufficient to support the leaning weight of the user and a configuration of straps to provide support in a limited or enclosed space. In various embodiment, the apparatus contains a detachable chair strap that is secured to a chair and provides stability to the apparatus in use by a Velcro connection to the enveloping components of the suspension strap. The apparatus may also be configured to allow a user to slidably move the suspension strap to position the resting platform at a comfortable position and angle relative to the upper body of the user.

DETAILED DESCRIPTION OF EMBODIMENTS OF THE INVENTION

Figure 1:
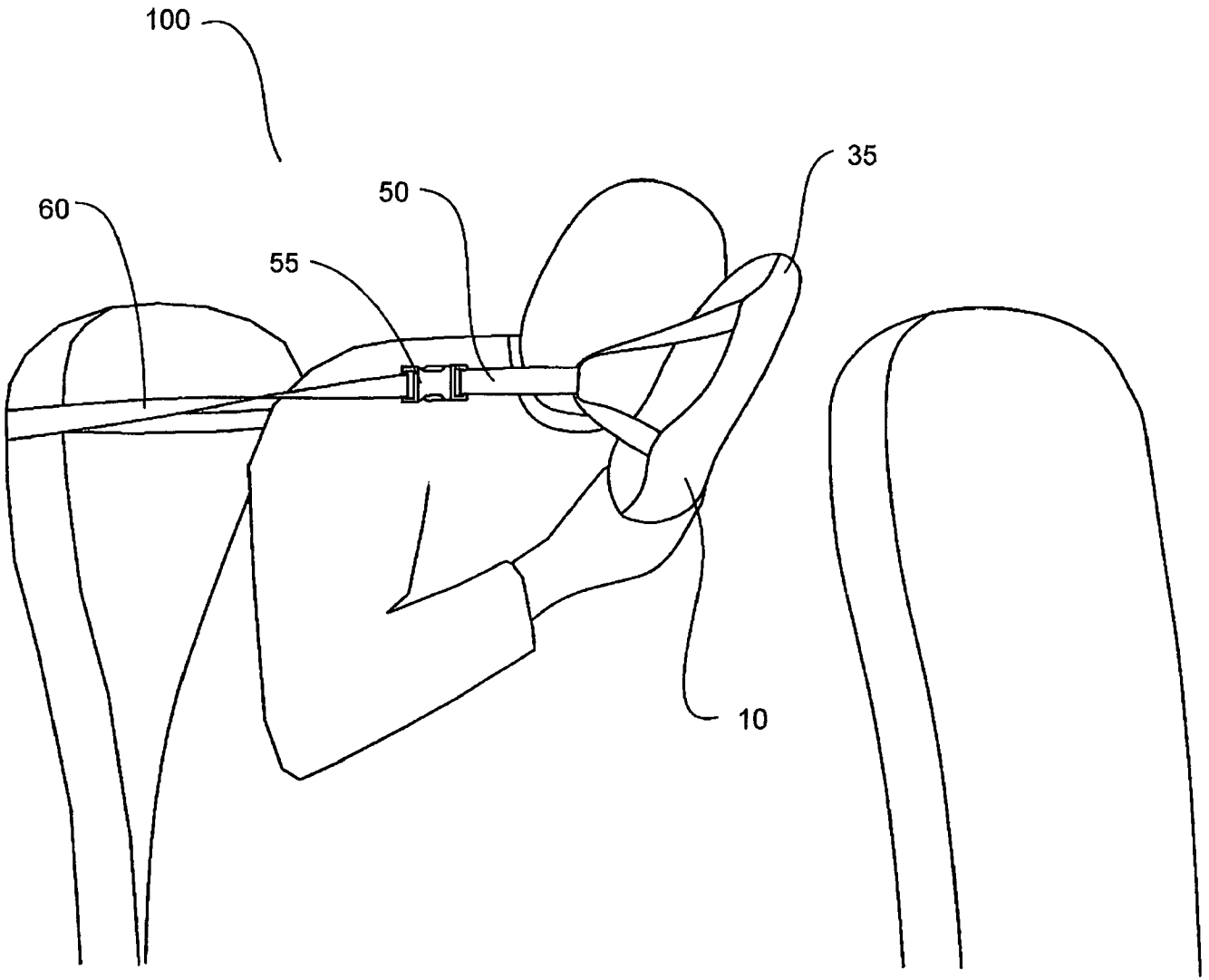
FIG. 1 shows one embodiment of an assembled Resting Apparatus in use.

For the purpose of promoting an understanding of the present invention, references are made in the text hereof to embodiments of a resting apparatus, only some of which are described herein. It should nevertheless be understood that no limitations on the scope of the invention are thereby intended. One of ordinary skill in the art will readily appreciate that modifications such as the dimensions of a resting apparatus, alternate but functionally similar material(s) from which the resting apparatus described is comprised. The inclusion of additional elements may be deemed readily apparent and obvious to one of ordinary skill in the art, and all equivalent relationships to those described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related. For example, one embodiment of the resting apparatus as disclosed herein may be comprised of a single, multi-dimensional and/or textured component, while others may include multiple multi-dimensional and/or textured component.

Referring now to the drawings, FIG. 1 shows one embodiment of resting apparatus 100 in use that includes resting platform 10 and strap system 12. In the embodiment shown, resting platform 10 is comprised of panels 20 (not shown), cushion layers 40 (not shown) and removable cover 35. In the exemplary embodiment, strap system 12 is also shown, which is comprised generally of optional support loop straps 30*a* and 30*b*; buckle straps 50; suspension strap 60; optional enveloping components 70*a*, 70*b* and 70*c*; and chair strap 80.

Also visible in the embodiment shown in FIG. 1 are additional strap system 12 components female buckle end 55 and male buckle end 58 which, when connected as shown, secure buckle straps 50 to suspension strap 60. Additionally, the embodiment of resting apparatus 100 shown in FIG. 1 includes enveloping components 70 and chair strap 80, which help to secure suspension strap 60 to a user's chair.

Figure 2:
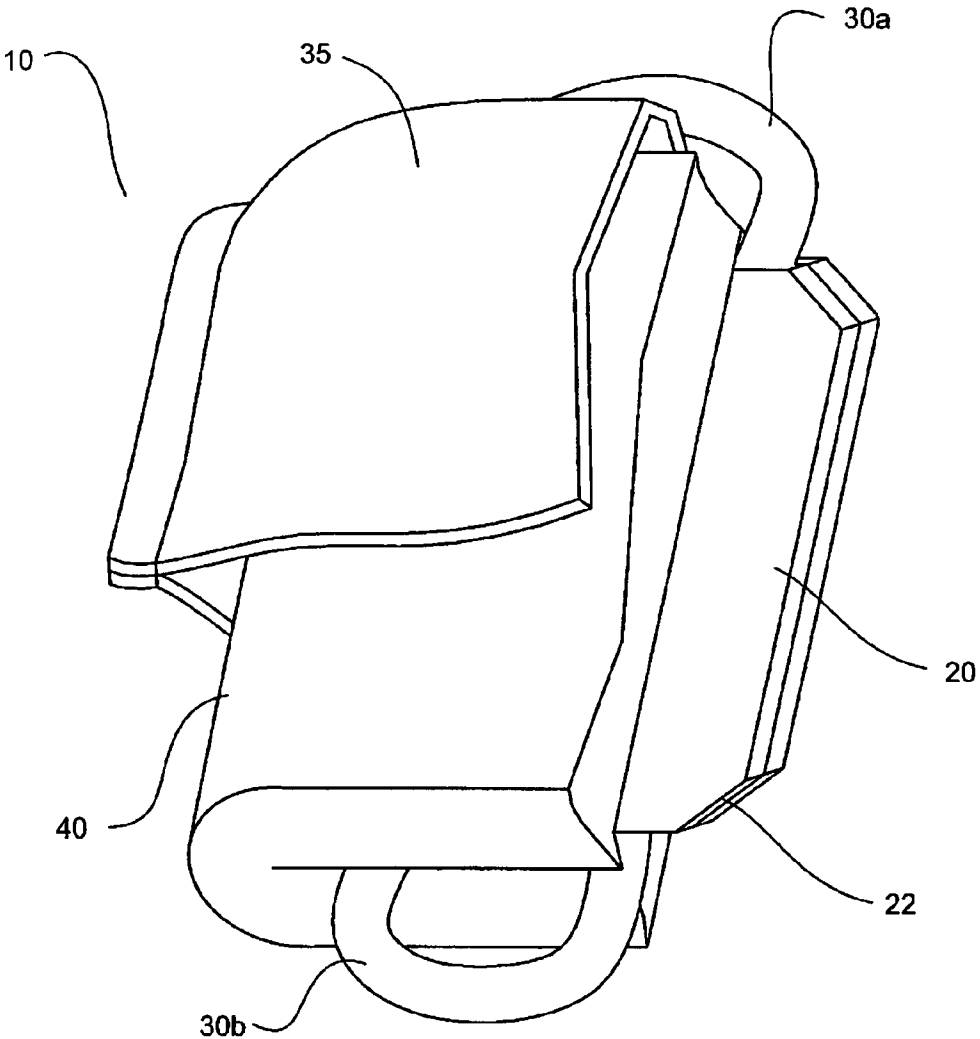
FIG. 2 shows a cross-sectional view of one embodiment of an inner support structure as used in a Resting Apparatus.

The embodiment in FIG. 2 illustrates a cross-sectional view of one embodiment of inner support structure 200 as used in resting apparatus 100. In the embodiment shown, inner support structure 200 includes panel 20 and optional support loop straps 30*a* and 30*b*, which are resting platform attachment points. In the exemplary embodiment, panel 20 is a substantially rigid board made from two connected sheets of $1/8^{th}$ inch hardboard. In alternate embodiments, panel 20 may be made from hardboard, plastic, fiberglass or any other material known in the art, and may be flat, as in FIG. 2, contoured, curved, and include ridges or other contours for additional user comfort. In other embodiments, panel 20 may contain at least one panel, but may include multiple panels when appropriate, each panel being no more than ¼ inch in thickness.

Various embodiments of resting apparatus 100 may further include a component selected from a group consisting of an audio component, a storage pocket component, a sound buffering component, a heating component, an aromatic component, a specifically contoured shape to anthropometrically conform to user's body. Resting apparatus 100 may also be sold with a storage case and optional detached pillow.

As shown in the embodiment in FIG. 2, support loop straps 30*a* and 30*b* are securely affixed to the sides of panel 20 to create loops of fabric. In the embodiment in FIG. 2, loop straps 30*a* and 30*b* are made from 1-inch nylon fabric, but may be made from other fabrics known in the art.

The embodiment in FIG. 2 also illustrates a cushion layer 40 surrounding panel 20. Cushion layer 40 bonds, in the embodiment in FIG. 2, to panel 20 with contact adhesive and completely surrounds panel 20. In various embodiments panel 20 may included rounded, contoured or chamfered corners. In the embodiment in FIG. 2, cushion layer 40 is made from high density foam known in the art, but may be made from other materials known in the art that provide cushion for a leaning weight (e.g., head, torso, neck and/or upper body).

Figure 3:
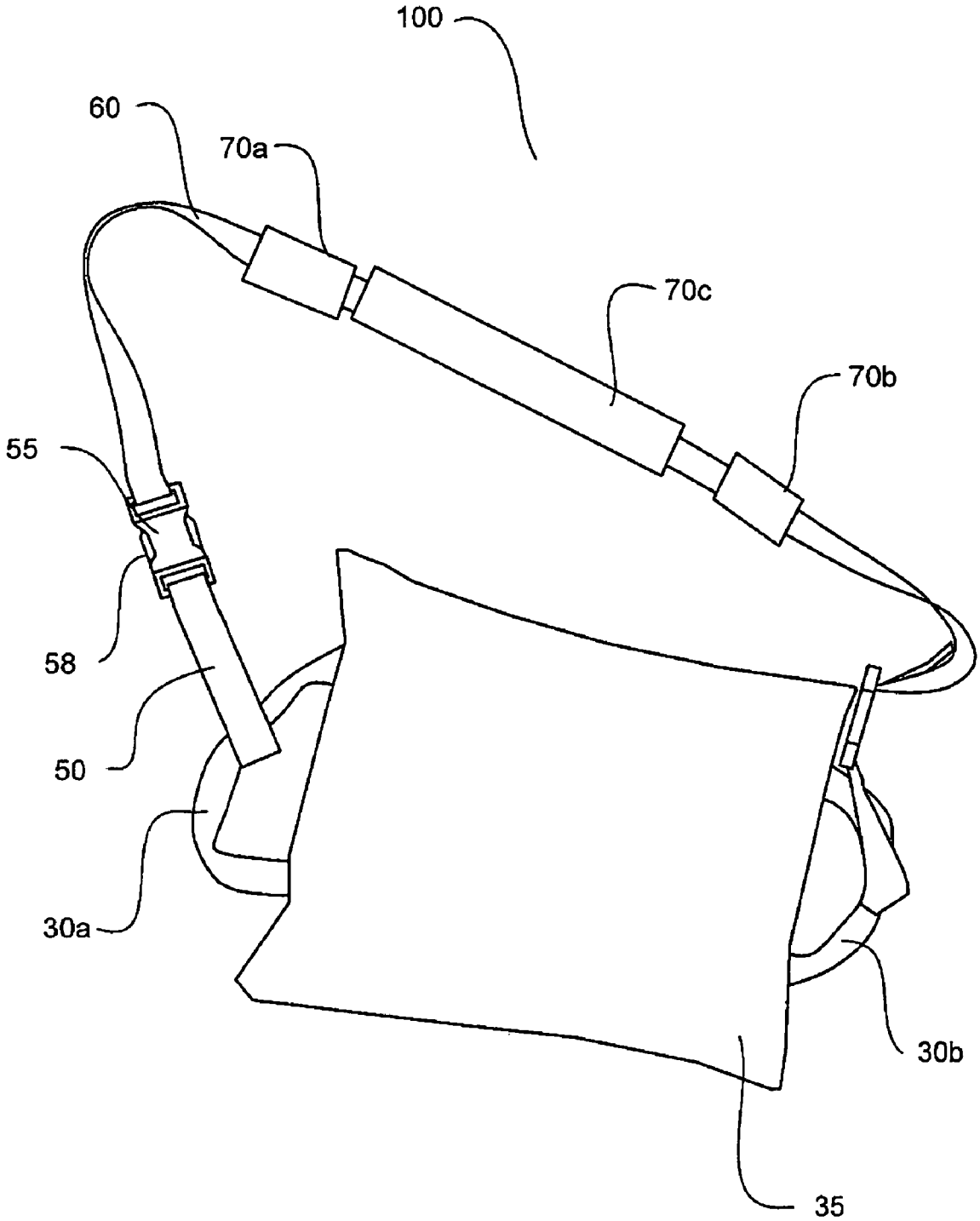
FIG. 3 shows a freestanding view of one embodiment of an assembled Resting Apparatus

The embodiment in FIG. 3 shows a freestanding view of one embodiment of an assembled resting apparatus 100. In the exemplary embodiment, buckle straps 50, which are movably connected to optional loop straps 30*a* and 30*b* by a retaining loop of strap material. In the exemplary embodiment, buckle straps 50 are made from 1-inch nylon webbing fabric, but may be made from other material known in the art (including polyester webbing, nylon webbing, plastic, leather, rubber, fabric, and combinations thereof. Buckle straps 50 can be connected to loop straps 30*a* and 30*b*, in other embodiments, by molded plastic, metal or other material to allow movement, formed in a buckle, clip, clasp, circle, or other shape to enclose loop straps 30*a* and 30*b*. In alternate embodiments without loop straps 30*a* and 30*b*, buckle straps 50 may be directly attached to lightweight panel 20.

In the embodiment shown in FIG. 3, buckle straps 50 are assembled, with one end connected to loop straps 30*a* and 30*b*, and the other end connected to suspension strap 60. The embodiment in FIG. 3 shows female buckle 55 affixed to the terminal end of buckle straps 55. Female buckle 55 accepts male buckle 58, which is attached to each terminal end of suspension strap 60.

In the embodiment shown in FIG. 3 enveloping components 70*a*, 70*b* and 70*c* are also shown, attached to suspension strap 60. Enveloping components 70*a*, 70*b* and 70*c* are, in the embodiment shown, two pieces of fabric attached along both long ends to allow suspension strap 60 to slide between both pieces. In the embodiment shown, the surface facing the user on enveloping components 70*a*, 70*b* and 70*c* contains a pressure resistant attachment substance and, when assembled attached securely to chair strap 80 to prevent suspension strap 60 from sliding up or down chair. Thus envisioned, suspension strap 60 will be secured to chair, but a user may still slide suspension strap 60 through enveloping components 70*a*, 70*b* and 70*c* to position resting apparatus 100 in a desirable angle and/or position.

Figure 4:
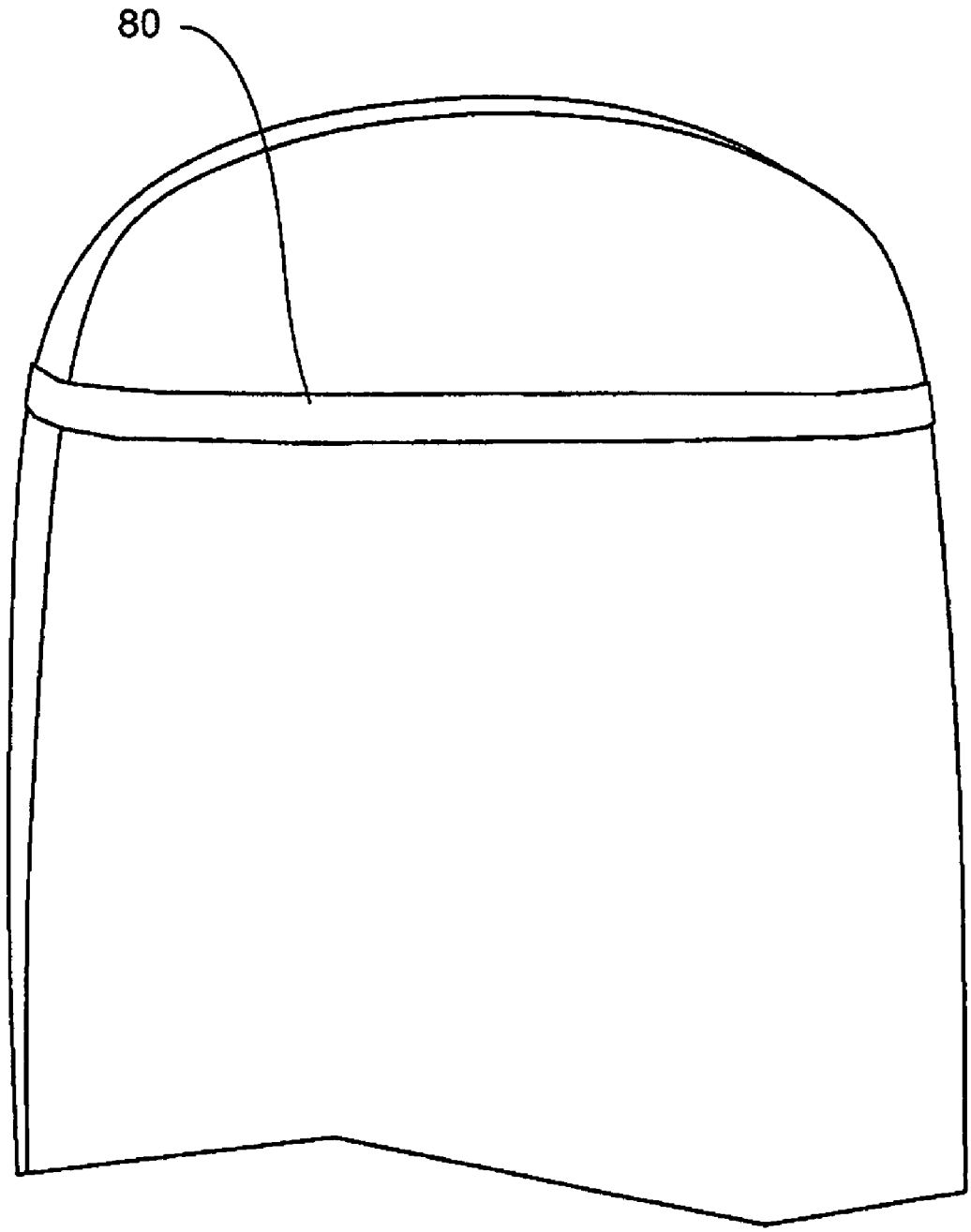
FIG. 4 shows one embodiment of an assembled chair strap as used in a Resting Apparatus.

In the embodiment shown in FIG. 4, chair strap 80 is shown disassembled from resting apparatus 100. Chair strap 80 is a separate strap that securely fastens around a chair. A pressure resistant attachment substance runs along the entire length of one surface of chair strap 80. The opposite surface contains at least one quarter of the entire surface a pressure resistant attachment substance, which serves to fasten chair strap 80 securely to a chair.

What is claimed is:

1. An resting apparatus comprised of:

a resting platform comprised of an inner support structure having a first edge, a second edge, a third edge and a fourth edge comprised of at least one rigid board, at least two support loop straps securely attached to said inner support structure at said first edge and said second edge, and at least one cushioning layer substantially enclosing said inner support structure, said cushioning layer further including at least two apertures, at least one moveably connected buckle strap of a fixed length affixed to each of said at least two support loop straps, each of said moveably connected buckle straps having a first end movably connected to said support loop strap and a second end with a female buckle end, at least one chair strap with a first surface that includes a hook-and-loop fastener and a second surface that is coated with a pressure resistant attachment substance over at least 25% of its surface to prevent said chair strap from sliding up or down a chair back; and a secure suspension strap of a length greater than said fixed length of said moveably connected buckle straps comprised of two ends, each of said ends terminating in a male buckle end adapted to engage said female buckle ends of said moveably connected buckle straps, and at least one enveloping component slidably affixed around said secure suspension strap including a user-facing surface with a pressure resistant attachment substance securely releasably attaching said at least one chair strap to said secure suspension strap, wherein said secure suspension strap provides one or more upward, diagonal forces sufficient to support said the leaning of a user on the resting platform and enable a user to rest in a seated position within a confined space; and wherein said at least one enveloping component allows a user to slidingly adjust the position of said resting platform; and at least one securing component for said secure suspension strap.

2. The resting apparatus of claim 1 in which said chair strap has at least one securing component to secure said chair strap to the back of a chair.

3. The resting apparatus of claim 1 wherein said resting platform includes at least one additional layer selected from a group consisting of padding layers, foam layers, quilted layers, a removable cover, a textured layer and a textured cover.

4. The resting apparatus of claim 1, wherein said resting platform is anthropometrically contoured for use by children.

5. The resting apparatus of claim 1 wherein said secure suspension strap is capable of being adjusted for length.

6. The resting apparatus of claim 1 wherein said secure suspension strap is capable of being separately adjusted for length on either side to allow said resting platform to be positioned at an angle.

7. A resting apparatus comprised of:

a resting platform comprised of an inner support structure which having a first edge, a second edge, a third edge and a fourth edge comprised of at least one rigid board;

at least two support loop straps securely attached to said inner support structure at said first edge and said second edge, a cushioning layer substantially enclosing said inner support structure, said cushioning layer further including at least two apertures, at least one additional layer, and a removable cover;

at least one moveably connected buckle strap of a fixed length affixed to each of said at least two support loop straps, each of said moveably connected buckle straps having a first end movably connected to said support loop strap and a second end with a female buckle end, at least one chair strap with a first surface that includes a hook-and-loop fastener and a second surface that is coated with a pressure resistant attachment substance over at least 25% of its surface to prevent said chair strap from sliding up or down a chair back; and a secure, adjustable suspension strap of a length greater than said fixed length of said moveably connected buckle straps comprised of two ends, each of said ends terminating in a male buckle end adapted to engage said female buckle ends of said moveably connected buckle straps, and at least one enveloping component slidably affixed around said secure suspension strap including a user-facing surface with a pressure resistant attachment substance adapted to securely releasably attach said at least one chair strap to said secure, adjustable suspension strap, wherein said secure, adjustable suspension strap provides one or more upward forces sufficient to support the leaning of a user on said resting platform and enable said user to rest in a seated position within a confined space; and wherein said at least one enveloping component allows a user to slidingly adjust the position of said resting platform; and at least one single release side adjust buckle which may be used to adjust the length of said secure, adjustable suspension strap.

8. The resting apparatus of claim 7 wherein said at least one additional layer is selected from a group consisting of padding layers, foam layers, quilted layers, a textured layer and a textured cover.

9. The resting apparatus of claim 7 wherein said secure, adjustable suspension strap is capable of being separately adjusted for length on either side to allow said resting platform to be positioned at an angle.

* * * * *